US007204292B2

(12) United States Patent
Nien

(10) Patent No.: US 7,204,292 B2
(45) Date of Patent: Apr. 17, 2007

(54) WINDOW BLIND HAVING MULTIPLE DRIVING MODES

(75) Inventor: Ming Nien, Changhua Hsien (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 614 days.

(21) Appl. No.: 10/651,111

(22) Filed: Aug. 29, 2003

(65) Prior Publication Data

US 2005/0011616 A1 Jan. 20, 2005

(30) Foreign Application Priority Data

Jul. 16, 2003 (TW) ..... 92213029 U

(51) Int. Cl.
*E06B 9/38* (2006.01)

(52) U.S. Cl. ..... 160/168.1 R; 160/173 R; 160/178.1 R; 160/309

(58) Field of Classification Search ..... 160/309, 160/310, 170, 171, 173 R; 16/429; 74/546
See application file for complete search history.

(56) References Cited

U.S. PATENT DOCUMENTS 1,978,152 A * 10/1934 Ward ..... 160/171
4,422,493 A * 12/1983 Forquer ..... 160/133
4,917,167 A * 4/1990 Voss et al. ..... 160/84.02
5,547,008 A * 8/1996 Sullivan ..... 160/176.1 P
5,603,371 A * 2/1997 Gregg ..... 160/176.1 P
2004/0103995 A1* 6/2004 Nien ..... 160/170

FOREIGN PATENT DOCUMENTS

| | | |
|---|---|---|
| FR | 2 692 002 | 12/1993 |
| FR | 2705993 | * 12/1994 |
| NL | 9000285 | 9/1991 |

* cited by examiner

*Primary Examiner*—Blair M. Johnson
(74) *Attorney, Agent, or Firm*—Browdy and Neimark, PLLC

(57) ABSTRACT

A window blind is constructed to include a headrail, a blind body suspended below the headrail, a linking mechanism mounted inside the headrail and having a power input device fastened pivotally with the headrail and an actuator rotatable with the power input device and connectable to the blind body, and a driving control mechanism. The driving control mechanism includes a suspension rod suspended from the headrail and a controller detachably coupled to the suspension rod for enabling the suspension rod to be driven by the controller to rotate the power input device and to further drive the actuator to move the blind body, causing the blind body to change the window shading status.

8 Claims, 5 Drawing Sheets

WINDOW BLIND HAVING MULTIPLE DRIVING MODES

BACKGROUND OF THE INVENTION

1. Field of the Invention

The present invention relates generally to a window blind and, more specifically, to a window blind having multiple driving modes.

2. Description of the Related Art

Conventional window blinds include two types, one with the cord members exposed to the outside, the other with the cord members arranged in a hidden status. A window blind with exposed cord members is not safe in use because the exposed cord members are accessible to children, and an accident may happen when a child playing with the cord members for fun. Therefore, window blinds with exposed cord members are not popularly acceptable at the present time.

Various window blinds with hidden cord members have been disclosed, and have appeared on the market. These window blinds with hidden cord members include manually operated type window blinds and motor-driven type window blinds. A manually operated type window blind uses the tension force of a spring member or positioning cord member to support the bottom rail in position. The use of spring means or positioning cord member cannot eliminate the problem of elastic fatigue. When the problem of elastic fatigue occurred, the spring means or positioning cord member can no longer support the bottom rail accurately in position. Netherlands Patent No. 9000285 and France Patent No. 2692002 teach the use of an elongated handle to drive a linking mechanism at the outside of the headrail and to further change the shading status of the blind body. However, because the linking mechanism is located on the outside of the headrail at an overhead location, the handle must have a certain length. It is not easy to connect the handle to the linking mechanism (because the end of the handle held by the user is the fulcrum, the positioning of the other end of the handle becomes unstable when the fulcrum vibrated with the user's hand. Further, when driving the handle to turn the linking mechanism after connection of the handle to the linking mechanism, the handle may slip from the linking mechanism due to uneven application of force to the handle. In general, the control of the prior art window blinds is not convenient.

SUMMARY OF THE INVENTION

It is the main object of the present invention to provide a window blind, which enables the user to control the shading status of the blind body conveniently.

It is another object of the present invention to provide a window blind, which has no cord member or string means exposed to the outside, preventing hanging of the exposed cord member or string means on a child accidentally.

To achieve these objects of the present invention, the window blind comprises a headrail; a blind body suspended below the headrail and movable by an external force to change window shading status; a linking mechanism mounted inside the headrail and having a power input device fastened pivotally with the headrail and rotatable by an external force, and an actuator movable with the power input device and connectable to the blind body for moving the blind body to further change the window shading status upon rotation of the power input device; and a driving control mechanism. The driving control mechanism includes a suspension rod and a controller. The suspension rod has a top end coupled to the power input device and a bottom end downwardly spaced below the headrail at a distance and provided with a connecting portion. The controller has a connecting portion connectable to the connecting portion of the suspension rod for enabling the suspension rod to be driven by the controller to rotate the power input device.

DETAILED DESCRIPTION OF THE INVENTION

Figure 1:
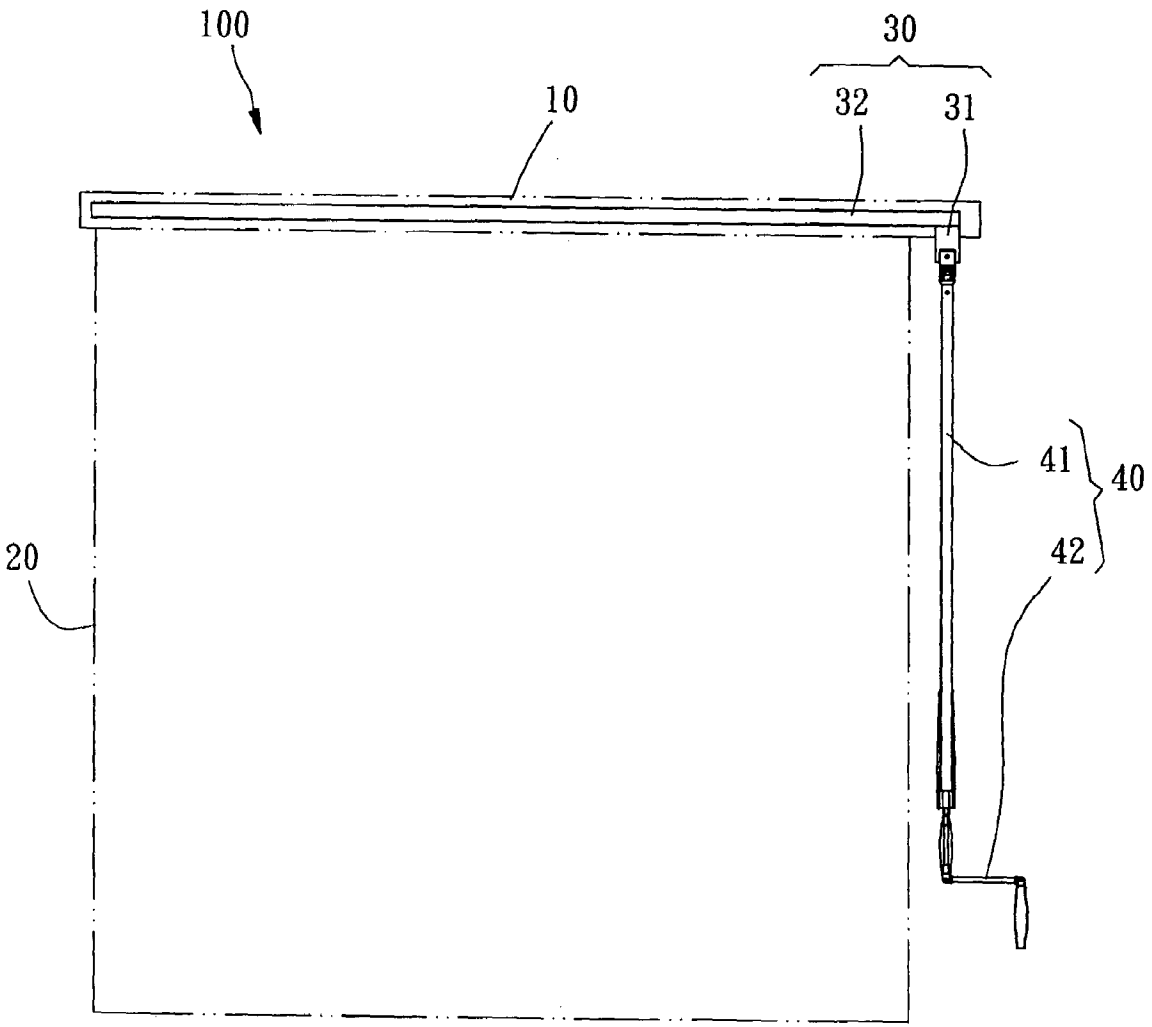
FIG. 1 is a schematic drawing showing the basic structure arrangement of a window blind according to the first preferred embodiment of the present invention.

Referring to FIG. 1, a window blind 100 in accordance with the first preferred embodiment of the present invention is shown comprised of a headrail 10, a blind body 20, a linking mechanism 30, and a driving control mechanism 40.

The headrail 10 is transversely (horizontally) affixed to the top side of the window (not shown). The blind body 20 can be a slat set for Venetian blind or a curtain for a window covering. According to this embodiment, the blind body 20 is a piece of curtain suspended below the headrail 10 at the one side of the window inside the house, and controlled by an external drive force to change its window shading status.

The linking mechanism 30 is a mechanical mechanism without power source installed in the headrail 10, comprising a power input device 31 and an actuator 32. The power input device 31 is rotatable by an external biasing force. The actuator 32 is directly (or indirectly) coupled to the blind body 20, and rotatable subject to the rotation of the power input device 31.

Figure 2:
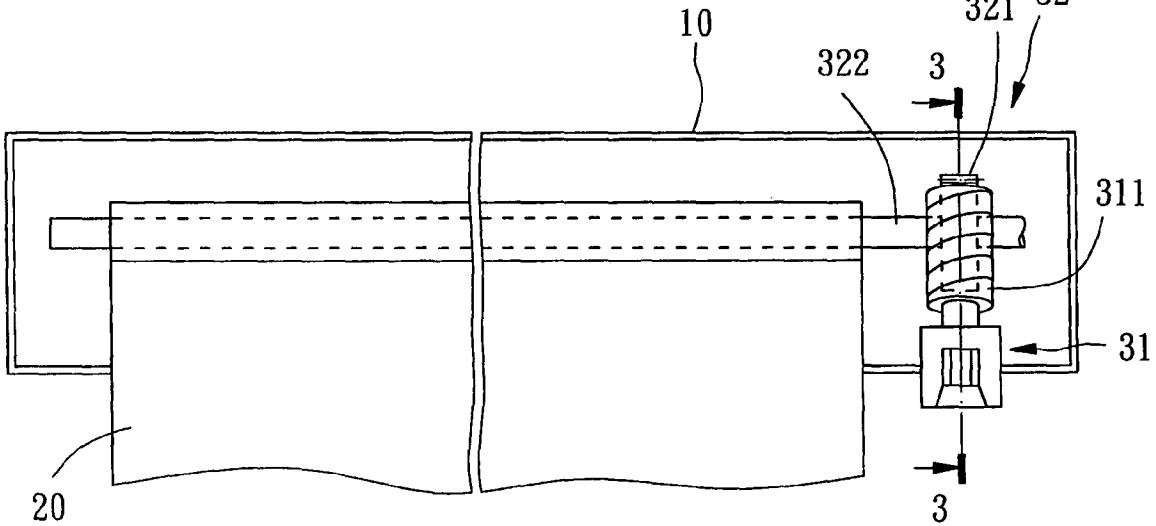
FIG. 2 is a schematic drawing in an enlarged scale of a part of FIG. 1.
Figure 3:
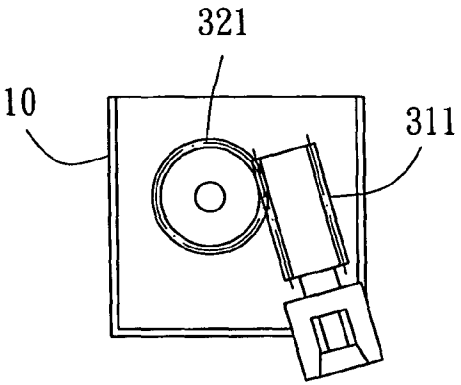
FIG. 3 is a sectional view taken along line 3—3 of FIG. 2.

Referring to FIGS. 2 and 3 and FIG. 1 again, the power input device 31 is comprised of a worm 311 fastened pivotally with the headrail 10 in vertical. The actuator 32 is comprised of a worm gear 321 fastened pivotally with the headrail 10 and meshed with the worm 311, and an axle 322 axially suspended in the headrail 10 and fixedly connected to the axial center of the worm gear 321. The blind body 20 has its top side edge fixedly connected in parallel to the periphery of the axle 322. When rotating the actuator 32, the blind body 20 is rolled up or let off, changing the window shading status. Alternatively meshed bevel gears may be used to substitute for the worm and worm gear.

Figure 4:
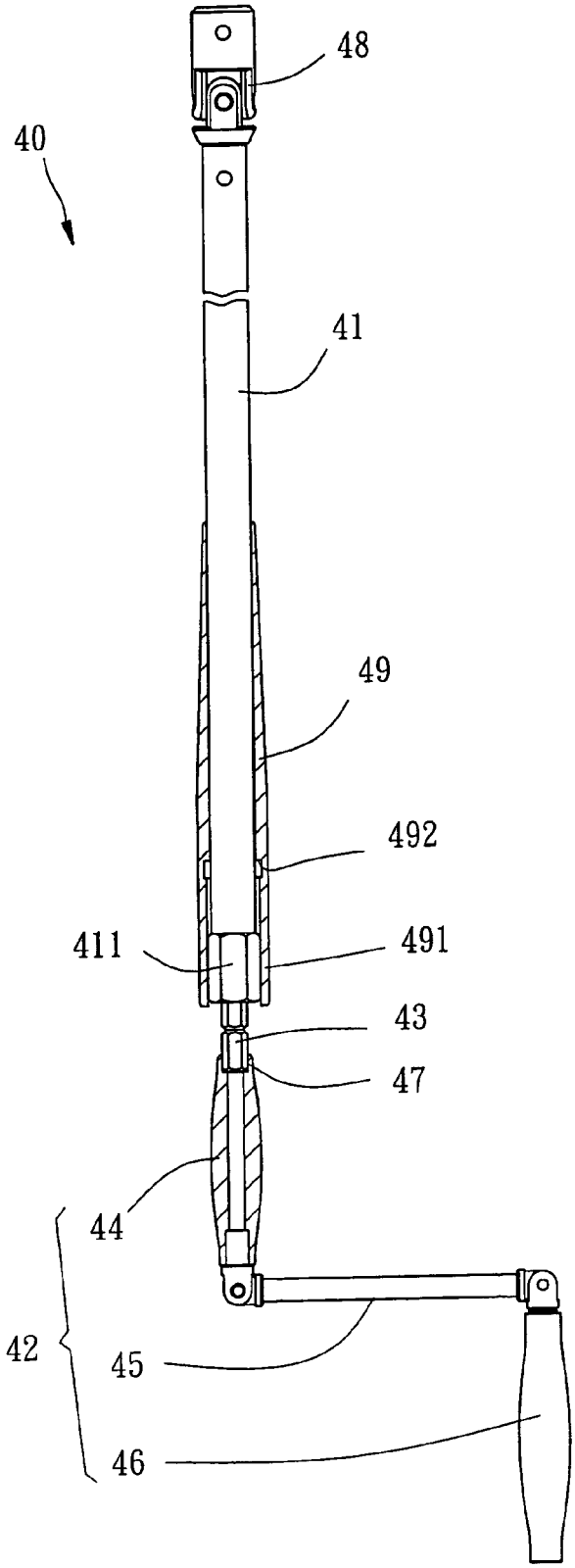
FIG. 4 is a sectional view of a part of the first preferred embodiment of the present invention, showing the protective sleeve moved to a first position and the controller set in the operative position.
Figure 5:
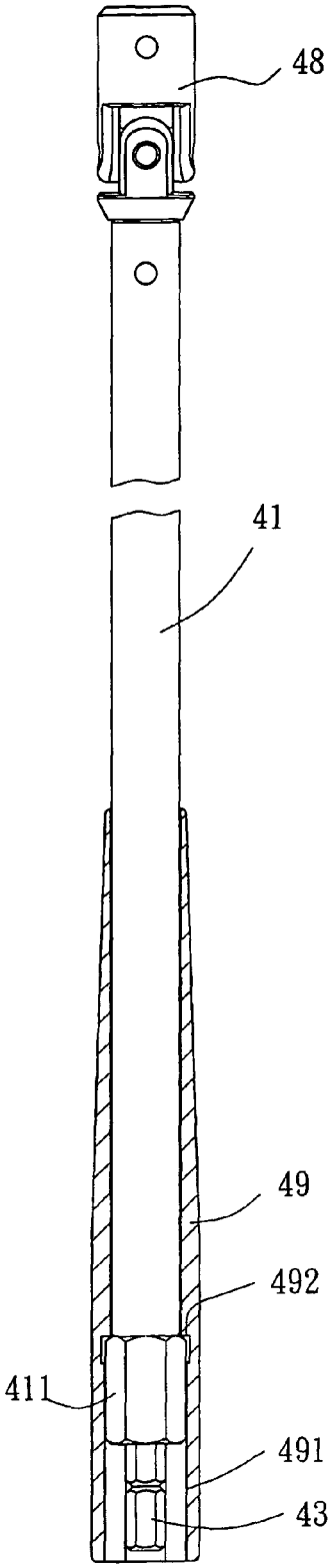
FIG. 5 is a sectional view of a part of the first preferred embodiment of the present invention, showing the protective sleeve moved to a second position.

The driving control mechanism 40 is comprised of a suspension rod 41 and a controller 42. The suspension rod 41 is a rod member having a predetermined length. The top end of the suspension rod 41 is coupled to the bottom end of the power input device 31 by a universal joint 48. The bottom end of the suspension rod 41 extends vertically downwardly to an elevation where the user's hand is conveniently accessible. Further, the bottom end of the suspension rod 41 forms into a hexagonal male coupling portion 411 and then a connecting portion 43. The outer diameter of the hexagonal coupling portion 411 is greater than the connecting portion 43. A protective sleeve 49 is sleeved onto the suspension rod 41 around the bottom end, having a hexagonal female coupling portion 491 coupled the hexagonal male coupling portion 411 for enabling the protective sleeve 49 to be moved axially along the suspension rod 41 between a first position where the connecting portion 43 is disposed outside the protective sleeve 49 (see FIG. 4) and a second position where the connecting portion 43 is received inside the protective sleeve 49 (see FIG. 5). The protective sleeve 49 further comprises stop means, for example, an inside stop flange 492 radially inwardly projecting from the top end of the periphery of the hexagonal female coupling portion 491. When the protective sleeve 49 moved to the second position, the inside stop flange 492 is stopped against a part of the suspension rod 41 at the top side of the hexagonal male coupling portion 411 to stop the protective sleeve 49 from falling out of the suspension rod 41 (see FIG. 5).

The controller 42 is a three-segment crank handle comprising a first driving rod 44, a second driving rod 45, and a third driving rod 46. The driving rods 44,45,46 are pivotally connected to one another in series such that the controller 42 can be alternatively set between an operative position where the second driving rod 45 kept in horizontal, keeping the first driving rod 44 and the third driving rod 46 vertically arranged in parallel, and a received position where the first driving rod 44, the second driving rod 45, and the third driving rod 45 are vertically aligned in a line. Further, the first driving rod 44 has a connecting portion 47 formed at its free end detachably coupled to the connecting portion 43 of the suspension rod 41. According to this embodiment, the connection portion 43 is formed of a hexagonal coupling rod, and the connecting portion 47 is a hexagonal coupling hole adapted to receive the hexagonal coupling rod of the connecting portion 43. After the connecting portion 47 of the controller 42 has been connected to the connecting portion 43 of the suspension rod 41 and the controller 42 has been set in the operative position, the user can then drive the third driving rod 46 to rotate the first driving rod 44 and the suspension rod 41 efficiently with less effort, thereby causing the power input device 31 of the linking mechanism 30 to move the blind body 20 to the desired shading status.

Therefore, when wishing to change the shading status of the blind body 20, the user can attach to the controller 42 to the suspension rod 41 and then drive the controller 42 to rotate the suspension rod 41 and to further drive the driving mechanism 40 to rotate the power input device 31 of the linking mechanism 30, causing the actuator 32 to move (to roll up/let off, to lift/lower, or to extend/receive) the blind body to the desired shading status. Because the bottom end of the suspension rod 41 is spaced below the headrail of the window blind at a distance where the user's hand is conveniently accessible, the user can conveniently attach the controller 42 to the suspension rod for operation.

Further, for a fine adjustment (lifting, lowering, or tilting the blind body gently), the user can directly rotate the suspension rod with the hand without the use of the controller.

Figure 7:
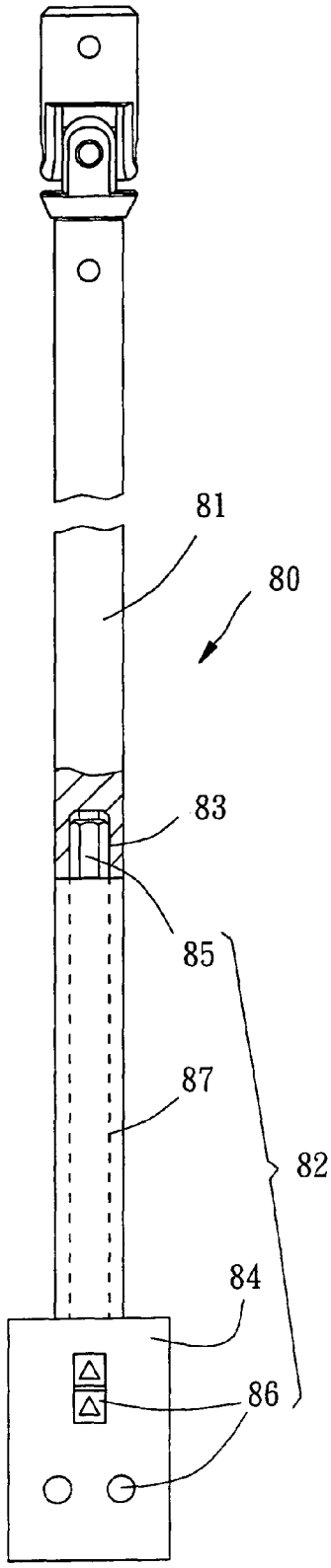
FIG. 7 is a schematic drawing in an enlarged scale of a part of FIG. 6, showing the arrangement of the driving control mechanism.
Figure 6:
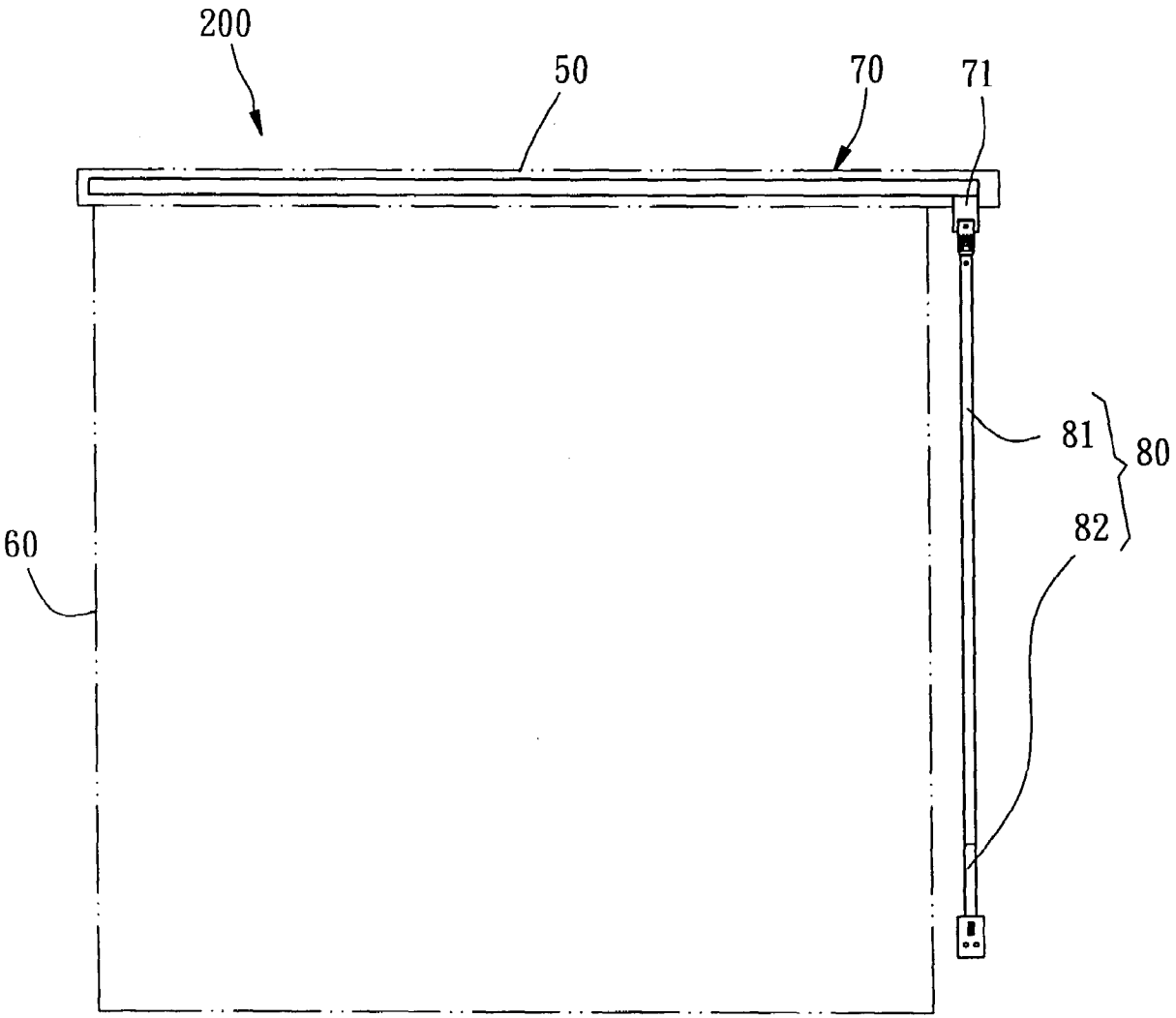
FIG. 6 is a schematic drawing showing the basic structure arrangement of a window blind according to the second preferred embodiment of the present invention.

FIGS. 6 and 7 show a window blind 200 constructed according to the second preferred embodiment of the present invention. According to this embodiment, the window blind 200 is comprised of a headrail 50, a blind body 60, a linking mechanism 70, and a driving control mechanism 80.

The driving control mechanism 80 is comprised of a suspension rod 81 and a controller 82. The suspension rod 81 is a rod member having a predetermined length. The top end of the suspension rod 81 is coupled to the bottom end of the power input device 71 of the linking mechanism 70. The bottom end of the suspension rod 81 extends vertically downwardly to an elevation where the user's hand is conveniently accessible and terminating in a connecting portion 83. According to this embodiment, the connecting portion 83 is a hexagonal coupling hole having an opening facing downwardly. The controller 82 is an electric controller comprising a handheld box 84, a transmission rod 87 extended out of the handheld box 84 and terminating in a coupling portion 85, for example, a hexagonal coupling tip detachably fitted into the hexagonal coupling hole of the connecting portion 83 of the suspension rod 81, a reversible motor (not shown) mounted inside the handheld box 84 and adapted to rotate the transmission rod 87, a battery pack (not shown) mounted inside the handheld box 84 and adapted to provide the necessary working voltage to the reversible motor, and control switches 86 adapted to control the operation of the reversible motor (for example, to control forward/backward rotation of the reversible motor at a high speed and to further extend/receive the blind body, or to control forward/backward rotation of the reversible motor at a low speed and to further adjust the tilting angle of the slats of the blind body).

When wishing to change the shading status of the blind body 60, the coupling portion 85 of the controller 82 is attached to the connecting portion 83 of the suspension rod 81, and then the control switches 86 are operated to turn the transmission rod 87 and then the suspension rod 81 and the power input device 71, thereby causing the blind body 60 to be moved to change the shading status.

As indicated above, the window blind with multiple driving modes according to the present invention has the following features and advantages.

1. A window blind made according to the present invention has no cord member or string means exposed to the outside, preventing hanging of exposed cord member or string means on a child accidentally. Therefore, a window blind made according to the present invention is in conformity with the market window blind developing trend and the related window covering safety codes.

2. Because the controller is set in the position conveniently accessible to the user's hand, the user can conveniently drive the window blind through a manual driving mode (through the three-segment crank handle type controller) or a motor driving mode (through the electric controller).

3. Because the invention does not use the tension force of spring means or cord means to support the blind body at the desired elevation, the invention eliminates the blind body unstable positioning problem due to elastic fatigue of spring means or loosening of cord means, and can control (or maintain) the status of the blind body steadily.

4. The user can directly rotate the suspension rod with the hand, or use a manually operated crank handle or an electric controller to drive the suspension rod. Therefore, the window blind provides multiple driving modes for selection.

What is claimed is:

1. A window blind comprising:

a headrail adapted to be fixedly mounted on a top side of a window;

a blind body suspended below said headrail and movable by an external force to change window shading status;

a linking mechanism mounted inside said headrail and having a power input device rotatable by an external force, and an actuator rotatable with said power input device and connectable to said blind body for moving said blind body to further change said window shading status upon rotation of said power input device;

a driving control mechanism having a suspension rod and a controller, said suspension rod having a top end coupled to said power input device and a bottom end downwardly spaced below said headrail at a distance and provided with a connecting portion, said controller having a connecting portion connectable to the connecting portion of said suspension rod for enabling said suspension rod to be driven by said controller to rotate said power input device; and wherein said driving control mechanism further comprises a protective sleeve sleeved onto said suspension rod and axially movable along said suspension rod between a first position where the connecting portion of said suspension rod is disposed outside said protective sleeve, and a second position where the connecting portion of said suspension rod is received inside said protective sleeve.

2. The window blind as claimed in claim 1, wherein said controller is a three-segment crank handle comprising a first driving rod, a second driving rod, and a third driving rod respectively pivotally connected to one another in series.

3. The window blind as claimed in claim 1, wherein the connecting portion of said controller is a polygonal coupling hole; the connecting portion of said suspension rod is a polygonal rod member fitting the polygonal coupling hole of said controller.

4. The window blind as claimed in claim 1, wherein the connecting portion of said suspension rod is a polygonal coupling hole, and the connecting portion of said controller is a polygonal rod member fitting the polygonal coupling hole of said suspension rod.

5. The window blind as claimed in claim 1, wherein said protective sleeve has an inside stop flange, which stops against a part of said suspension rod to stop said protective sleeve from falling out of said suspension rod when said protective sleeve moved to said second position.

6. The window blind as claimed in claim 1, wherein said suspension rod has a polygonal male coupling portion, and said protective sleeve has a polygonal female coupling portion, which receives the polygonal mal coupling portion to guide axial movement of said protective sleeve along said suspension rod.

7. The window blind as claimed in claim 1, wherein said controller comprises a motor, and a transmission rod coupled to said motor, said transmission rod having a free end forming the connecting portion of said controller.

8. The window blind as claimed in claim 7, wherein said controller further comprises a power source, which provides said motor with the necessary working power, and a plurality of control switches, which control the operation of said motor.

* * * * *